US008384490B2

(12) United States Patent
Kishimoto

(10) Patent No.: US 8,384,490 B2
(45) Date of Patent: Feb. 26, 2013

(54) NON-RECIPROCAL CIRCUIT AND NON-RECIPROCAL CIRCUIT DEVICE, AND CENTRAL CONDUCTOR ASSEMBLY USED THEREIN

(75) Inventor: Yasushi Kishimoto, Tottori (JP)

(73) Assignee: Hitachi Metals, Ltd., Tokyo (JP)

( * ) Notice: Subject to any disclaimer, the term of this patent is extended or adjusted under 35 U.S.C. 154(b) by 56 days.

(21) Appl. No.: 12/988,280

(22) PCT Filed: Apr. 17, 2009

(86) PCT No.: PCT/JP2009/057768

§ 371 (c)(1),
(2), (4) Date: Oct. 15, 2010

(87) PCT Pub. No.: WO2009/128534

PCT Pub. Date: Oct. 22, 2009

(65) Prior Publication Data

US 2011/0037529 A1 Feb. 17, 2011

(30) Foreign Application Priority Data

Apr. 18, 2008 (JP) ..... 2008-109123
Apr. 18, 2008 (JP) ..... 2008-109124
Apr. 18, 2008 (JP) ..... 2008-109125

(51) Int. Cl.
*H01P 1/36* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS 7,253,697 B2 * 8/2007 Soda et al. ..... 333/24.2
2004/0263278 A1 12/2004 Hino
2007/0046390 A1 3/2007 Soda et al.

FOREIGN PATENT DOCUMENTS

JP 62-258503 A 11/1987
JP 09-232818 A 9/1997
JP 2004-015430 A 1/2004
JP 2005-20195 A 1/2005
JP 2006-311455 A 11/2006
WO 2006/011382 A1 2/2006
WO 2007/091544 A1 8/2007

* cited by examiner

*Primary Examiner* — Stephen Jones
(74) *Attorney, Agent, or Firm* — Sughrue Mion, PLLC

(57) ABSTRACT

A central conductor assembly for use in a non-reciprocal circuit comprising a first inductance element between a first input/output port and a second input/output port, and a second inductance element between the second input/output port and a ground port, a magnetic substrate being integrally provided with a first central conductor constituting the first inductance element and a second central conductor constituting the second inductance element; and the second central conductor being crossing the first central conductor on a main surface side of the substrate via a magnetic layer or a dielectric layer, with at least one end portion thereof bent such that high-frequency current flows therethrough in the same direction as or in an opposite direction to that of high-frequency current flowing through the first central conductor.

10 Claims, 19 Drawing Sheets

RELATED ART

RELATED ART

RELATED ART

RELATED ART

NON-RECIPROCAL CIRCUIT AND NON-RECIPROCAL CIRCUIT DEVICE, AND CENTRAL CONDUCTOR ASSEMBLY USED THEREIN

CROSS REFERENCE TO RELATED APPLICATIONS

This application is a National Stage of International Application No. PCT/JP2009/057768, filed on Apr. 17, 2009, which claims priority from Japanese Patent Application Nos. 2008-109123, 2008-109124, and 2008-109125, filed on Apr. 18, 2008 respectively, the contents of all of which are incorporated herein by reference in their entirety.

FIELD OF THE INVENTION

The present invention relates to a non-reciprocal circuit called isolator for use in microwave communications apparatuses such as cell phones, etc., a non-reciprocal circuit device and a central conductor assembly used therein.

BACKGROUND OF THE INVENTION

The isolator functioning to permit signals to pass in a forward direction while preventing signals from passing in a reverse direction is used to remove reverse-direction signals from a communications apparatus. In a cell phone, for example, radiation efficiency is improved by utilizing radiation from a metal portion of a casing to increase an apparent antenna volume, but impedance varies under strong influence of adjacent human bodies, resulting in the likelihood that part of output signals are reflected by an antenna to generate reverse-direction signals. When such reverse-direction signals are input to a power amplifier directly, power efficiency is lowered, and noise is generated. Accordingly, an isolator is disposed between the antenna and the power amplifier. Such isolator comprises a magnetic body (microwave ferrite such as garnet), pluralities of central conductors crossing the magnetic body, and a permanent magnet applying a DC magnetic field to the magnetic body to generate a rotating resonance magnetic field therein.

FIG. 2 shows the equivalent circuit of a non-reciprocal circuit device called two-port isolator, which is disclosed in JP 2004-15430 A, and FIG. 28 shows the structure of the non-reciprocal circuit device. This two-port isolator comprises a first input/output port P1, a second input/output port P2, a first inductance element Lin and a first capacitance element Ci connected between both input/output ports P1, P2 for constituting a first parallel resonance circuit, a resistance element R connected in parallel to the first parallel resonance circuit, and a second inductance element Lout and a second capacitance element Cf connected between the second input/output port P2 and a ground for constituting a second parallel resonance circuit. In the two-port isolator, the first parallel resonance circuit sets a frequency for providing the maximum isolation (attenuation in a reverse direction), and the second parallel resonance circuit sets a frequency providing the minimum insertion loss.

The first inductance element Lin and the second inductance element Lout are constituted by a first central conductor Lin and a second central conductor Lout formed by strip-shaped conductors and crossing on a main surface side of a ferrite plate to which a DC magnetic field is applied from the permanent magnet 30. A part comprising the magnetic body and the first and second central conductors is called a central conductor assembly 4.

In this example, the first capacitance element Ci and the second capacitance element Cf are constituted by electrode patterns in a multi-layer ceramic substrate 10. The multi-layer ceramic substrate 10 is provided on a main surface with an electrode pad 15 and connecting pads 17, 18. The electrode pad 15 is connected to a terminal electrode P2 of the second central conductor Lout formed on a side surface of the multi-layer ceramic substrate 10 through a via-hole electrode and a side surface electrode. The connecting pad 17 is connected to a terminal electrode P1 of the first central conductor Lin formed on a side surface of the multi-layer ceramic substrate 10 through a via-hole electrode and a side surface electrode. The connecting pad 18 is connected to ground electrodes GND through via-hole electrodes and side surface electrodes. As the first capacitance element Ci and the second capacitance element Cf, multi-layer chip capacitors, and single-layer capacitors formed on upper and lower surfaces of a dielectric substrate may be used. The permanent magnet 30, the central conductor assembly 4 and the multi-layer ceramic substrate 10 are received in upper and lower cases 22, 25 made of a magnetic metal.

According to the miniaturization of cell phones and increase in the number of their parts due to multi-functionalization, there is strong demand to make isolators smaller. Although isolators having external sizes of 3.2 mm×3.2 mm×1.2 mm or 3.2 mm×2.5 mm×1.2 mm are widely used at present, there is further demand for smaller isolators of 2.0 mm×2.0 mm×1.1 mm, for example. According to such miniaturization, central conductor assemblies constituting two-port isolators should be miniaturized.

Conventionally proposed are central conductor assemblies having various structures, for example, a central conductor assembly comprising a copper foil wound around a ferrite plate; a laminate-type central conductor assembly (disclosed in JP 9-232818 A) obtained by laminating pluralities of dielectric sheets printed with electrode patterns for the central conductors and integrally sintering them as shown in FIG. 29, etc.

To obtain a small isolator of 2.0 mm×2.0 mm, a central conductor assembly should have an external size reduced to about 1.5 mm×1.2 mm. The miniaturization of the central conductor assembly results in the decreased volume of a magnetic body and shorter central conductors, providing the central conductors with smaller inductance. Accordingly, capacitance elements should have large capacitance to achieve resonance at a desired frequency, which is difficult because of the miniaturization of the non-reciprocal circuit device. As a result, the input/output impedance deviates from the impedance of an external circuit to cause mismatching, likely resulting in deteriorated insertion loss, a shrunken pass-band width, etc.

To cope with impedance deviation, an impedance-matching circuit is connected to an input/output port of the non-reciprocal circuit. FIG. 27 shows an example in which a matching circuit 90 is arranged on the side of a first input/output port P1. Capacitance element Cz is connected when the input impedance is inductive, and an inductance element is connected when the impedance is capacitive. However, the addition of a matching circuit increases the number of parts, hindering the miniaturization of the non-reciprocal circuit device.

Objects of the Invention

Accordingly, an object of the present invention is to provide a central conductor assembly having impedance matching without increasing the number of parts, thereby avoiding impedance deviation without having a further matching circuit.

Another object of the present invention is to provide small non-reciprocal circuit and device each comprising such central conductor assembly for having excellent electric characteristics such as insertion loss, etc.

DISCLOSURE OF THE INVENTION

The first central conductor assembly of the present invention for use in a non-reciprocal circuit comprising a first inductance element between a first input/output port and a second input/output port, and a second inductance element between the second input/output port and a ground port, a magnetic substrate being integrally provided with a first central conductor constituting the first inductance element and a second central conductor constituting the second inductance element;

the second central conductor being crossing the first central conductor on a main surface side of the substrate via a magnetic layer or a dielectric layer; and at least one end portion of the second central conductor being bent, such that high-frequency current flows therethrough in the same direction as or in an opposite direction to that of high-frequency current flowing through the first central conductor.

By bending an end portion of the second central conductor such that high-frequency current flows substantially in the same direction as or in an opposite direction to that of high-frequency current flowing through the first central conductor, the input impedance of a non-reciprocal circuit or device can be made inductive or capacitive.

The second central conductor assembly of the present invention for use in a non-reciprocal circuit comprising a first inductance element between a first input/output port and a second input/output port, and a second inductance element between the second input/output port and a ground port, a magnetic substrate being integrally provided with a first central conductor constituting the first inductance element and a second central conductor constituting the second inductance element;

the second central conductor being in the form of a coil of 1.5 turns or more constituted by pluralities of strip-shaped conductors formed on a main surface side of the substrate and series-connected to at least one strip-shaped conductor formed on a rear surface side of the substrate; and pluralities of strip-shaped conductors for the second central conductor being crossing the first central conductor on a main surface side of the substrate via a magnetic layer or a dielectric layer.

By constituting the second central conductor in the form of a coil of 1.5 turns or more by pluralities of strip-shaped conductors formed on the main surface side and series-connected to at least one strip-shaped conductor formed on the rear surface side, large inductance can be obtained.

The third central conductor assembly of the present invention for use in a non-reciprocal circuit comprising a first inductance element between a first input/output port and a second input/output port, and a second inductance element between the second input/output port and a ground port, a magnetic substrate being integrally provided with a first central conductor constituting the first inductance element and a second central conductor constituting the second inductance element;

the second central conductor being in the form of a coil of 1.5 turns or more constituted by pluralities of strip-shaped conductors formed on a main surface side of the substrate and series-connected to at least one strip-shaped conductor formed on a rear surface side of the substrate;

pluralities of the strip-shaped conductors on a main surface side of the substrate being crossing the first central conductor via a magnetic layer or a dielectric layer; and at least one end portion of each of plural strip-shaped conductors of the second central conductor on a main surface side of the substrate being bent, such that high-frequency current flows therethrough in the same direction as or in an opposite direction to that of high-frequency current flowing through the first central conductor.

In the first to third central conductor assemblies, part of the first central conductor is preferably formed on a main surface of the substrate, while the other part is preferably formed in the substrate.

The first inductance element preferably has smaller inductance than that of the second inductance element. End portions of the first and second central conductors are preferably connected to terminal electrodes formed on a bottom surface through via-holes or electrodes formed on side surfaces of the substrate.

The non-reciprocal circuit of the present invention comprises the above central conductor assembly, a permanent magnet applying a DC magnetic field to the central conductor assembly, a first capacitance element constituting a first parallel resonance circuit with the first inductance element, and a second capacitance element constituting a second parallel resonance circuit with the second inductance element.

The non-reciprocal circuit device of the present invention comprises the above central conductor assembly, a permanent magnet applying a DC magnetic field to the central conductor assembly, a first capacitance element constituting a first parallel resonance circuit with the first inductance element, and a second capacitance element constituting a second parallel resonance circuit with the second inductance element, the first and second capacitance elements being formed in a multi-layer substrate, and the central conductor assembly being mounted on a main surface of the multi-layer substrate.

The first method of the present invention for adjusting the impedance of a non-reciprocal circuit comprising a first parallel resonance circuit comprising a first inductance element and a first capacitance element disposed between a first input/output port and a second input/output port, and a second parallel resonance circuit comprising a second inductance element and a second capacitance element between the second input/output port and a ground port, comprises integrally providing a magnetic substrate with a first central conductor constituting the first inductance element and a second central conductor constituting the second inductance element;

disposing the second central conductor on a main surface side of the substrate such that it is crossing the first central conductor via a magnetic layer or a dielectric layer; and bending at least one end portion of the second central conductor such that high-frequency current flows therethrough in the same direction as or in an opposite direction to that of high-frequency current flowing through the first central conductor, thereby adjusting the impedance of the second parallel resonance circuit at a resonance frequency.

In the above impedance-adjusting method of a non-reciprocal circuit, (a) when an end portion of the second central conductor on the side of the ground port is bent such that high-frequency current flows therethrough in the same direction as that of high-frequency current flowing through the first central conductor, or when an end portion of the second central conductor on the side of the second input/output port is bent such that high-frequency current flows therethrough in an opposite direction to that of high-frequency current flowing through the first central conductor, impedance at a resonance frequency can be moved counterclockwise along an equi-conductance curve on a Smith chart, and (b) when an end portion of the second central conductor on the side of the ground port is bent such that high-frequency current flows therethrough in an opposite direction to that of high-frequency current flowing through the first central conductor, or when an end portion of the second central conductor on the side of the second input/output port is bent such that high-frequency current flows therethrough in the same direction as that of high-frequency current flowing through the first central conductor, impedance at a resonance frequency can be moved clockwise along an equi-conductance curve on a Smith chart.

The second method of the present invention for adjusting the impedance of a non-reciprocal circuit comprising a first parallel resonance circuit comprising a first inductance element and a first capacitance element disposed between a first input/output port and a second input/output port, and a second parallel resonance circuit comprising a second inductance element and a second capacitance element between the second input/output port and a ground port, comprises integrally providing a magnetic substrate with a first central conductor constituting the first inductance element and a second central conductor constituting the second inductance element;

series-connecting pluralities of strip-shaped conductors formed on a main surface side of the substrate to at least one strip-shaped conductor formed on a rear surface side of the substrate, to form the second central conductor in a coil of 1.5 turns or more; and disposing pluralities of strip-shaped conductors of the second central conductor on a main surface side of the substrate such that it is crossing the first central conductor via a magnetic layer or a dielectric layer, thereby adjusting the impedance of the second parallel resonance circuit at a resonance frequency.

BRIEF DESCRIPTION OF THE DRAWINGS

FIG. 6(*b*) is a chart showing the impedance characteristics of the central conductor assembly model of FIG. 6(*a*) determined by high-frequency, three-dimensional electromagnetic field simulation.

FIG. 7(*b*) is a chart showing the impedance characteristics of the central conductor assembly model of FIG. 7(*a*) determined by high-frequency, three-dimensional electromagnetic field simulation.

FIG. 8(*b*) is a chart showing the impedance characteristics of the central conductor assembly model of FIG. 8(*a*) determined by high-frequency, three-dimensional electromagnetic field simulation.

FIG. 9(*b*) is a chart showing the impedance characteristics of the central conductor assembly model of FIG. 9(*a*) determined by high-frequency, three-dimensional electromagnetic field simulation.

FIG. 10(*b*) is a chart showing the impedance characteristics of the central conductor assembly model of FIG. 10(*a*) determined by high-frequency, three-dimensional electromagnetic field simulation.

DESCRIPTION OF THE BEST MODE OF THE INVENTION

Figure 1:
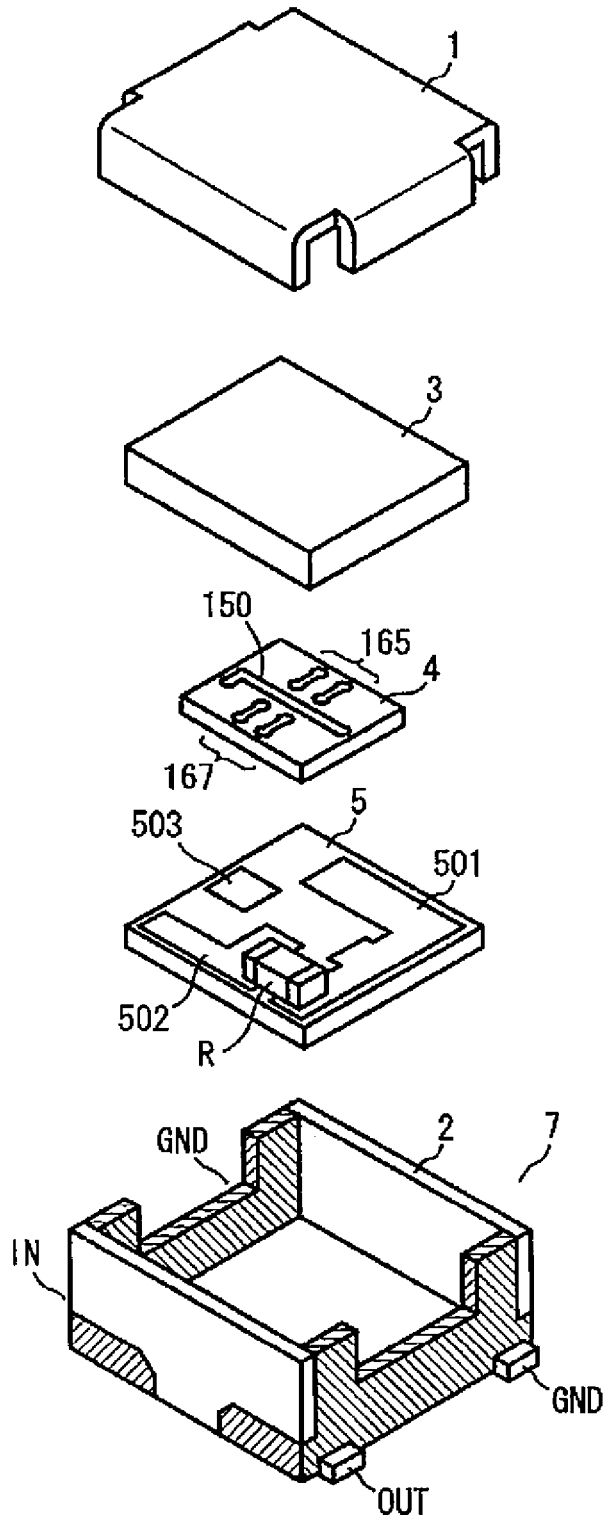
FIG. 1 is an exploded perspective view showing a non-reciprocal circuit device according to one embodiment of the present invention.
Figure 2:
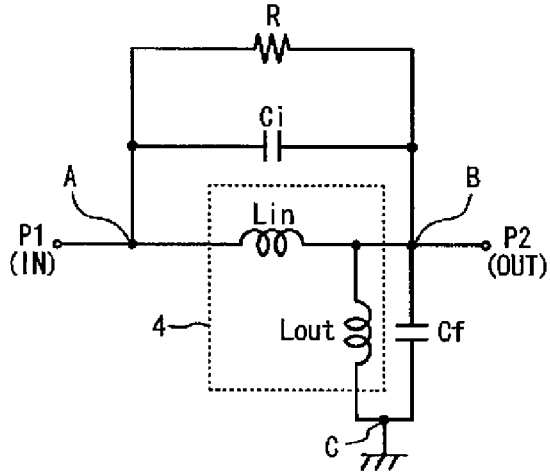
FIG. 2 is a view showing the equivalent circuit of the non-reciprocal circuit device according to one embodiment of the present invention.
Figure 3:
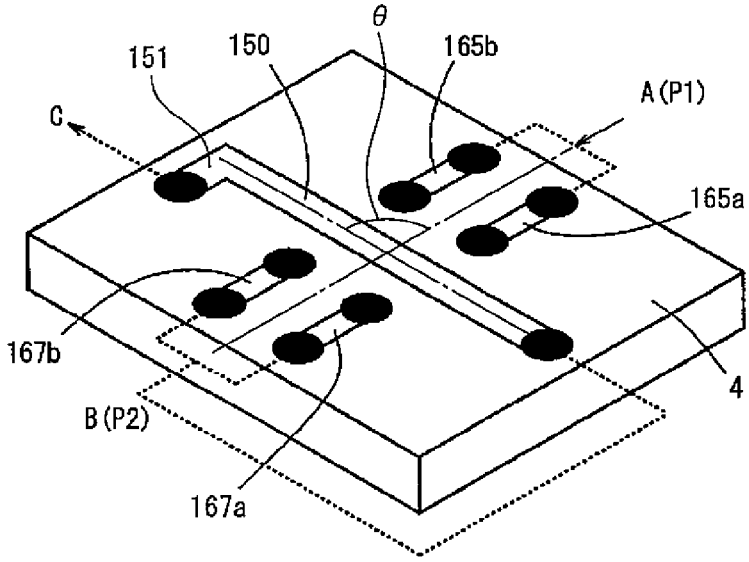
FIG. 3 is a perspective view showing the appearance of the central conductor assembly according to one embodiment of the present invention.
Figure 4:
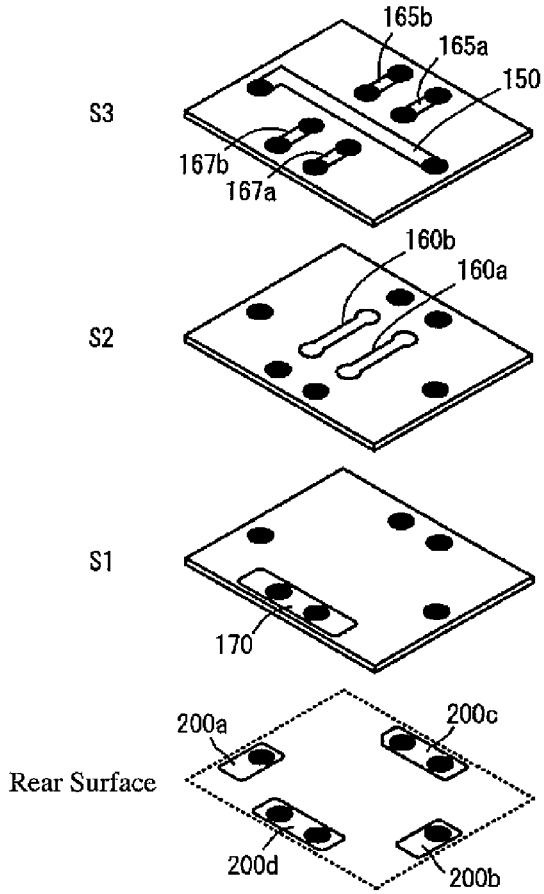
FIG. 4 is an exploded perspective view showing the internal structure of the central conductor assembly according to one embodiment of the present invention.
Figure 5:
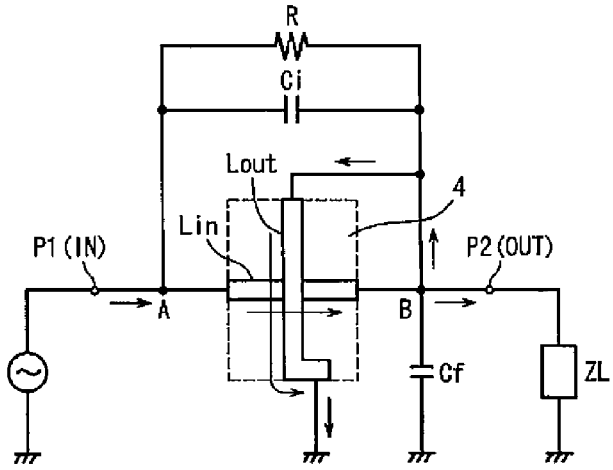
FIG. 5 is a schematic view showing the direction of high-frequency current in the non-reciprocal circuit device according to one embodiment of the present invention.

FIG. 1 shows the structure of a non-reciprocal circuit device according to one embodiment of the present invention, and FIG. 2 shows its equivalent circuit. This non-reciprocal circuit device comprises a central conductor assembly 4, a multi-layer ceramic substrate (capacitor laminate) 5 on which the central conductor assembly 4 is mounted, a resistor R mounted on the multi-layer ceramic substrate 5, a permanent magnet 3 applying a DC magnetic field to the central conductor assembly 4, and upper and lower metal cases 1, 2 acting as magnetic yokes. FIG. 3 shows the appearance of the central conductor assembly 4, and FIG. 4 shows the internal structure of the central conductor assembly 4. FIG. 5 shows the flowing direction of high-frequency current in a case where this non-reciprocal circuit device has an input (P1) side connected to a power supply, and output (P2) side connected to a matching load.

The central conductor assembly 4 is constituted by a first central conductor comprising first lines 165*a*, 165*b*, second lines 167*a*, 167*b* and third lines 160*a*, 160*b*, and a second central conductor 150 formed by one line. The central conductor assembly 4 is constituted by laminating layers S1-S3 in this order, lines formed on the layers S2, S3 being strip-shaped conductors. On the layer S3, the first lines 165*a*, 165*b* and the second lines 167*a*, 167*b* are arranged symmetrically on both sides of the second central conductor 150. Each third line 160*a*, 160*b* formed on the layer S2 is connected to one end of each first line 165*a*, 165*b* and one end of each second line 167*a*, 167*b* through a via-hole (shown by a black circle in the figure) formed in the layer S3. As a result, the first central conductor and the second central conductor are crossing via a magnetic layer. When only the layer S3 is made of a dielectric material, the first central conductor and the second central conductor are crossing via a dielectric layer.

In this example, the first central conductor are constituted by two parallel lines 165*a* and 165*b*, 167*a* and 167*b*, and 160*a* and 160*b*, and the second central conductor is constituted by one line 150. Such structure makes inductance obtained by the first central conductor smaller than that obtained by the second central conductor, thereby adjusting impedance, and thus obtaining excellent electric characteristics.

In the depicted example, the first to third lines 165*a* and 165*b*, 167*a* and 167*b*, and 160*a* and 160*b* are parallel to each other and perpendicular to the second central conductor 150, but it is not restrictive but may be changed within a range providing the effects of the present invention.

The input impedance is capacitive when the crossing angle θ (FIG. 3) of the first central conductor and the second central conductor is less than 90°, and inductive when it is more than 90°. The addition of such impedance change makes the margin of impedance adjustment larger, but the changing of the crossing angle needs the adjustment of a magnetic field, likely failing to obtain a magnetic field necessary for operating the non-reciprocal circuit. Accordingly, the crossing angle range is preferably 80°-110°.

The first feature of the present invention is that at least one end portion of the second central conductor 150 constituting the second inductance element Lout is bent. As shown in FIG. 5, current from the power supply passes through the first central conductor constituting the first inductance element Lin, and then through the second central conductor constituting the second inductance element Lout. In this embodiment, the second central conductor is bent in an L-shape, such that the bent end portion is parallel to the first central conductor, and extends in the same direction as that of current flowing through the first central conductor.

Though not restrictive, the formation method of the central conductor includes, for example, a method of printing a conductor paste on magnetic layers, a method of forming conductor layers on both surfaces of a flexible, heat-resistant, insulating sheet of polyimide, etc. and then etching them, etc.

Magnetic materials for the central conductor assembly 4 need only ensure the function of the non-reciprocal circuit to a DC magnetic field from a permanent magnet. The preferred magnetic materials include microwave ferrite having a garnet structure such as yttrium-iron-garnet (YIG), etc., and ferrite having a spinel structure such as Ni ferrite, etc. may be used depending on frequencies used. In the case of YIG, part of Y may be replaced by Gd, Ca, V, etc., and part of Fe may be replaced by Al, Ga, etc. When the first and second central conductors are printed, a predetermined amount of Bi may be added to YIG such that they are simultaneously sinterable with the central conductors.

The permanent magnet 3 applying a DC magnetic field to the central conductor assembly 4 is fixed to an inner surface of an upper case 1 with an adhesive, etc. From the aspect of cost and the compatibility of temperature characteristics with microwave ferrite, the permanent magnet 3 is preferably ferrite magnet such as $(Sr/Ba)O\text{-}nFe_2O_3$. Further, ferrite magnet having a composition represented by $(Sr/Ba)RO\text{-}n(FeM)_2O_3$, wherein R substituting for part of Sr and/or Ba is at least one rare earth element including Y, and M substituting for part of Fe is at least one element selected from the group consisting of Co, Mn, Ni and Zn, and having a magnetoplumbite-type crystal structure, the R element and/or the M element being added in the form of compounds in a pulverization step after calcination, has a high magnetic flux density, making it possible to miniaturize the non-reciprocal circuit device. With respect to magnetic characteristics, the ferrite magnet preferably has a residual magnetic flux density Br of 430 mT or more, particularly 440 mT or more, coercivity iHc of 340 kA/m or more, and a maximum energy product (BH)max of 35 kJ/$m^3$ or more.

The multi-layer ceramic substrate 5 is produced by an LTCC (low-temperature-cofirable ceramic) method. In this method, dielectric sheets made of low-temperature-sinterable ceramics are printed with a conductor paste based on Ag, Cu, etc. to form desired conductor patterns, and pluralities of dielectric sheets with conductor patterns are laminated and sintered. When the multi-layer ceramic substrate 5 is made of low-temperature-sinterable ceramics, high-dielectric-constant metals can be used for electrode patterns, suppressing loss due to electric resistance. In addition, the use of high-Q dielectric materials provides the non-reciprocal circuit device with extremely small loss.

Smith charts (FIGS. 6-10) show the evaluation results of the influence of a bent end portion 151 of the second central conductor 150 on the non-reciprocal circuit device by high-frequency, three-dimensional electromagnetic field simulation. A to C in the central conductor assembly correspond to connecting points A to C in the equivalent circuit of FIG. 2, dotted lines indicating their connections, and the arrows indicating the direction of current i.

Figure 6A:
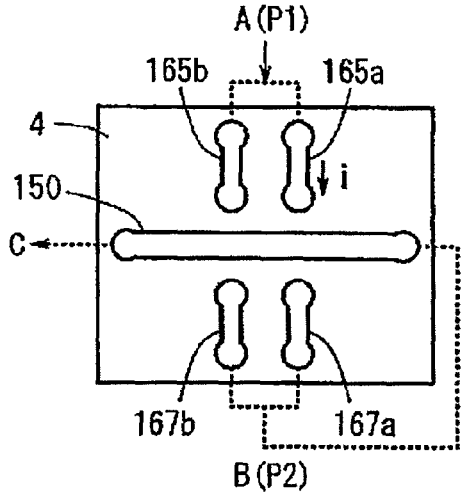
FIG. 6(*a*) is a plan view showing one model of the central conductor assembly.
Figure 6B:
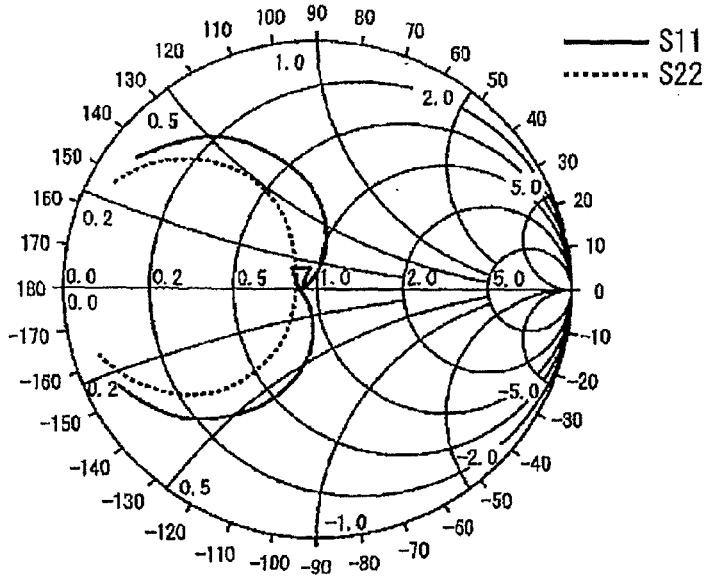
RELATED ART Fig. 6(b)
Figure 7A:
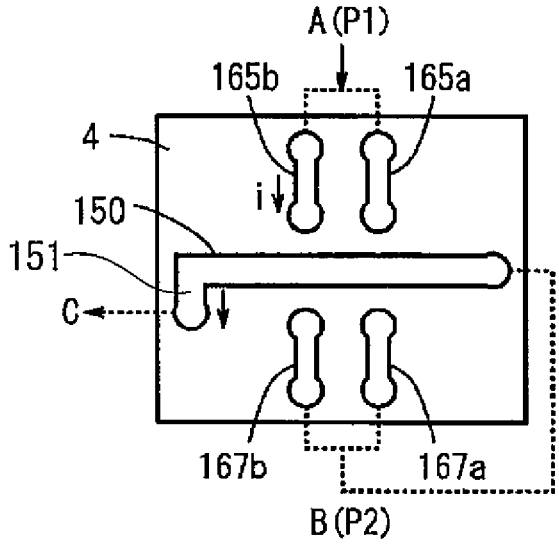
FIG. 7(*a*) is a plan view showing another model of the central conductor assembly.
Figure 7B:
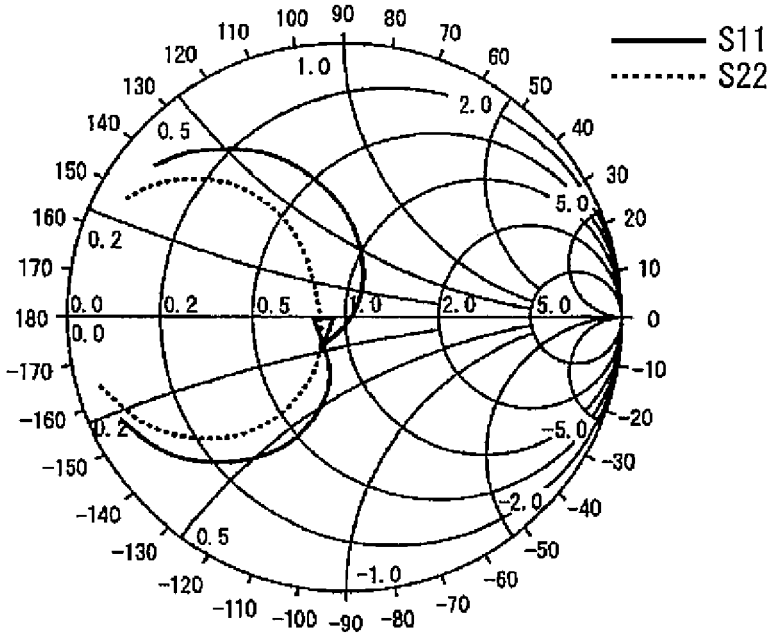
Figure 8A:
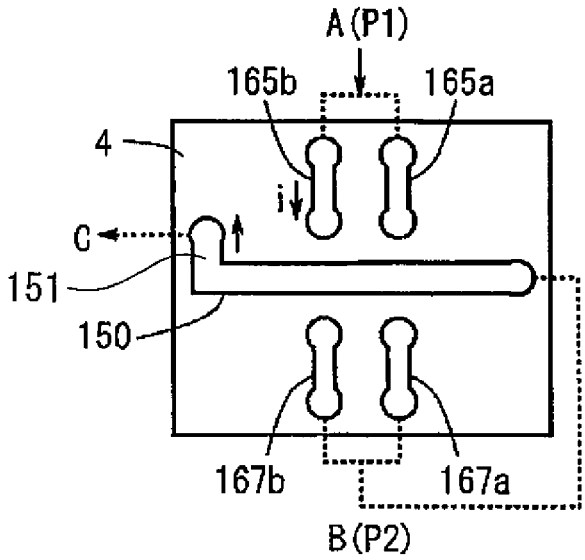
FIG. 8(*a*) is a plan view showing a further model of the central conductor assembly.
Figure 8B:
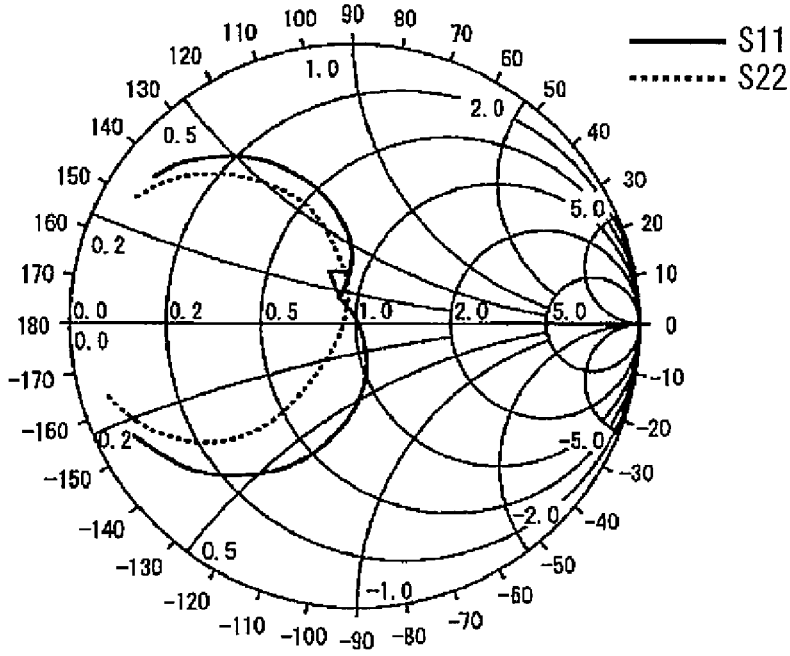
Figure 9A:
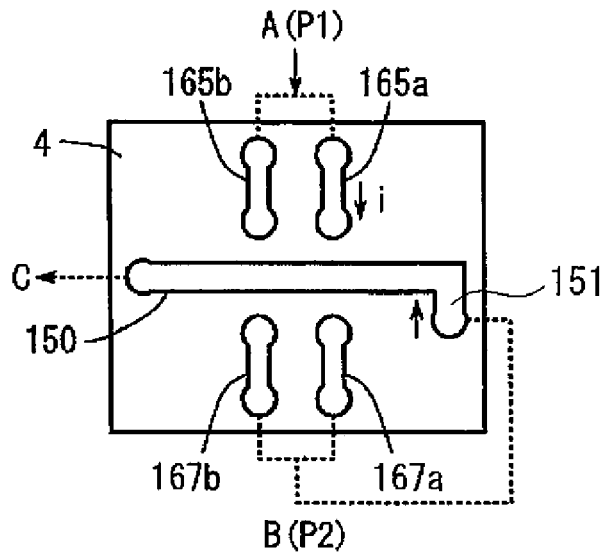
FIG. 9(*a*) is a plan view showing a still further model of the central conductor assembly.
Figure 9B:
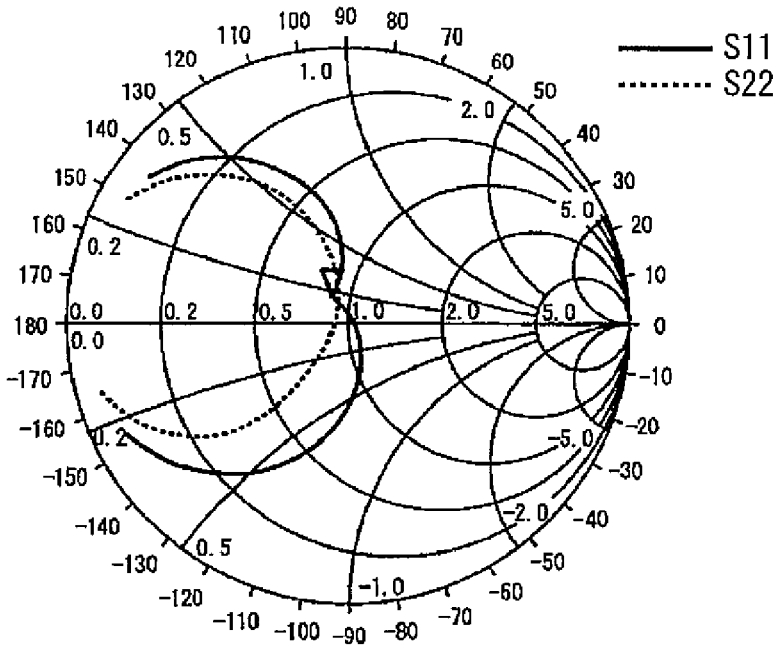
Figure 10A:
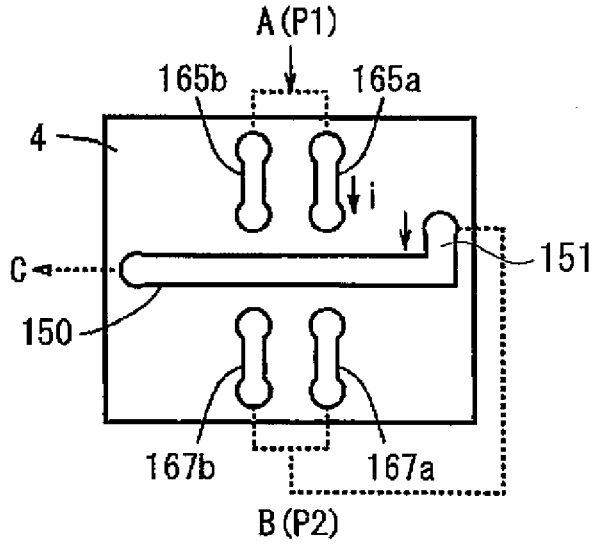
FIG. 10(*a*) is a plan view showing a still further model of the central conductor assembly.
Figure 10B:
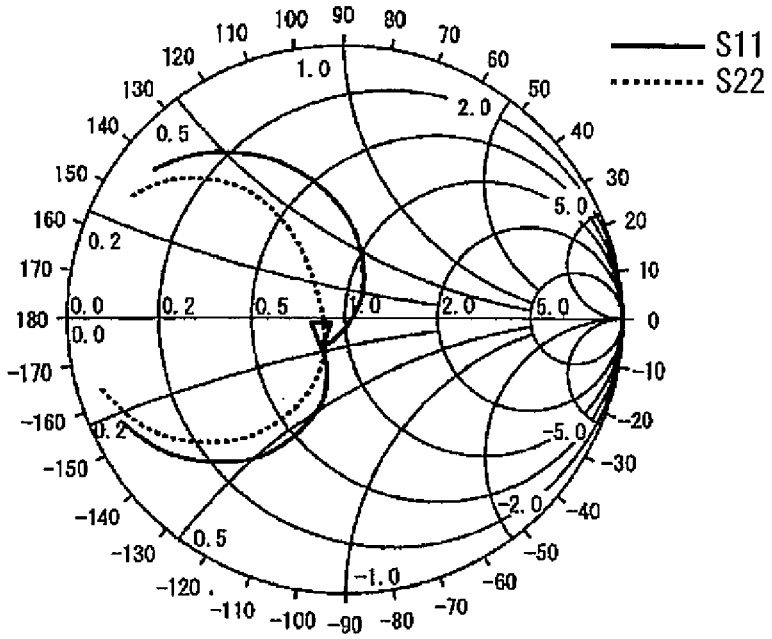

FIG. 6(*a*) shows a conventional model having no bent portion in the second central conductor 150, which is designed to achieve matching at 1.95 GHz, and FIG. 6(*b*) shows its S11 and S22 impedance characteristics. FIG. 7(*a*) shows a model in which an end portion of the second central conductor 150 on the side of the connecting point C (ground) is bent in parallel to the first central conductor, such that high-frequency current flows therethrough in the same direction as that of current flowing through the first central conductor, and FIG. 7(*b*) shows its S11 and S22 impedance characteristics. FIG. 8(*a*) shows a model in which an end portion of the second central conductor 150 on the side of the connecting point C (ground) is bent in parallel to the first central conductor, such that high-frequency current flows therethrough in an opposite direction to that of current flowing through the first central conductor, and FIG. 8(*b*) shows its S11 and S22 impedance characteristics. FIG. 9(*a*) shows a model in which an end portion of the second central conductor 150 on the side of a connecting point B (second input/output port P2) is bent in parallel to the first central conductor, such that high-frequency current flows therethrough in an opposite direction to that of current flowing through the first central conductor, and FIG. 9(*b*) shows its S11 and S22 impedance characteristics. FIG. 10(*a*) shows a model in which an end portion of the second central conductor 150 on the side of the connecting point B (second input/output port P2) is bent in parallel to the first central conductor, such that high-frequency current flows therethrough in the same direction as that of current flowing through the first central conductor, and FIG. 10(*b*) shows its S11 and S22 impedance characteristics.

Simulation has revealed that (a) by bending an end portion of the second central conductor 150 on the side of the ground port such that high-frequency current flows therethrough in an opposite direction to that of current flowing through the first central conductor, or by bending an end portion of the second central conductor 150 on the side of the second input/output port P2 such that high-frequency current flows therethrough in an opposite direction to that of current flowing through the first central conductor, impedance at a resonance frequency can be moved counterclockwise along an equi-conductance curve on the Smith chart, and that (b) by bending an end portion of the second central conductor 150 on the side of the ground port such that high-frequency current flows therethrough in the same direction as that of current flowing through the first central conductor, or by bending an end portion of the second central conductor 150 on the side of the second input/output port P2 such that high-frequency current flows therethrough in the same direction as that of current flowing through the first central conductor, impedance at a resonance frequency can be moved clockwise along an equi-conductance curve on the Smith chart. It has also revealed that the longer the bent portion 151, the larger the impedance change. As is clear from this, whichever end portion of the second central conductor 150 is provided with a bent portion 151, impedance is capacitive when current flowing through the bent portion 151 of the second central conductor 150 is in the same direction as that of current flowing through the first central conductor, or inductive when it is in an opposite direction.

It is presumed that such change occurs by a magnetic field generated by current flowing through the bent portion 151 of the second central conductor 150, which acts on a high-frequency magnetic field generated from the first central conductor, thereby changing a magnetic flux distribution in the central conductor assembly 4.

Figure 11:
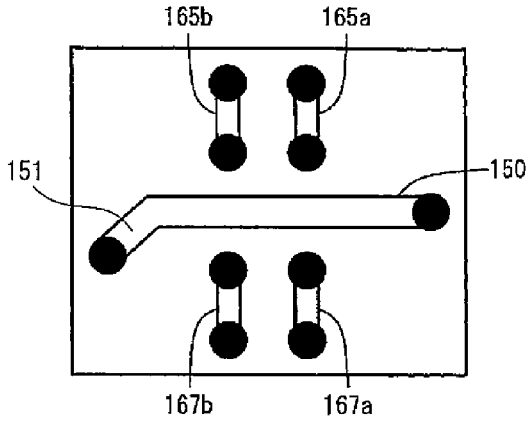
FIG. 11 is a plan view showing a central conductor assembly according to another embodiment of the present invention.
Figure 12:
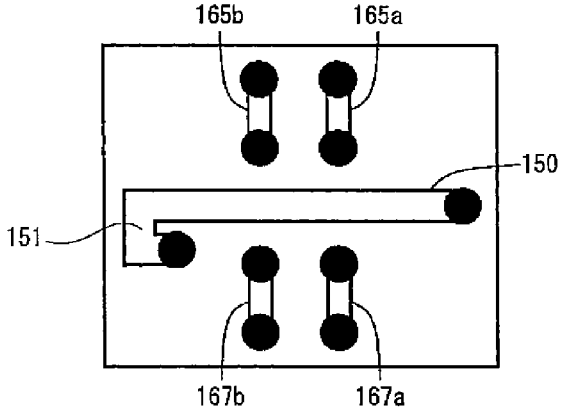
FIG. 12 is a plan view showing a central conductor assembly according to a further embodiment of the present invention.
Figure 13:
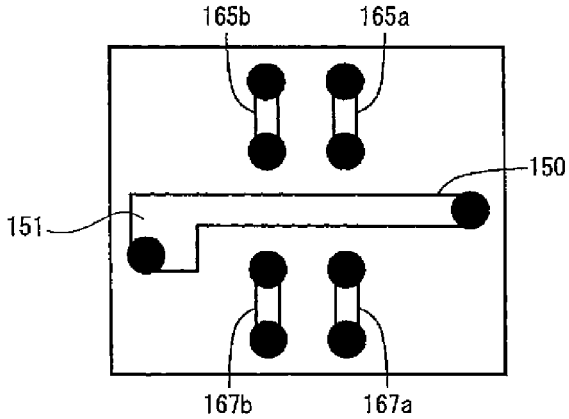
FIG. 13 is a plan view showing a central conductor assembly according to a still further embodiment of the present invention.

Although the end portion of the second central conductor 150 is bent to an L shape with the same width in parallel to the first central conductor in these examples, the width of the bent portion 151 and its angle to the first central conductor may be changed. The bent portion 151 of the second central conductor 150 is in an obtuse angle to the first central conductor in the example shown in FIG. 11, in a J shape in the example shown in FIG. 12, and wider in the example shown in FIG. 13. In these cases, too, impedance is capacitive when current direction in the bent portion 151 is in the same direction as that in the first central conductor, or inductive when it is in an opposite direction.

The same results are obtained when the first central conductor is constituted by a continuous, strip-shaped electrode formed in the central conductor assembly 4, and when both of the first central conductor and the second central conductor 150 are formed in the central conductor assembly 4.

Larger distance between the first central conductor and the end portion 150 of the second central conductor in a thickness direction provides smaller impedance change. For example, the formation of the bent end portion of the second central conductor 150 on a rear surface of the multi-layer ceramic substrate 5 provides extremely small impedance change.

Figure 14:
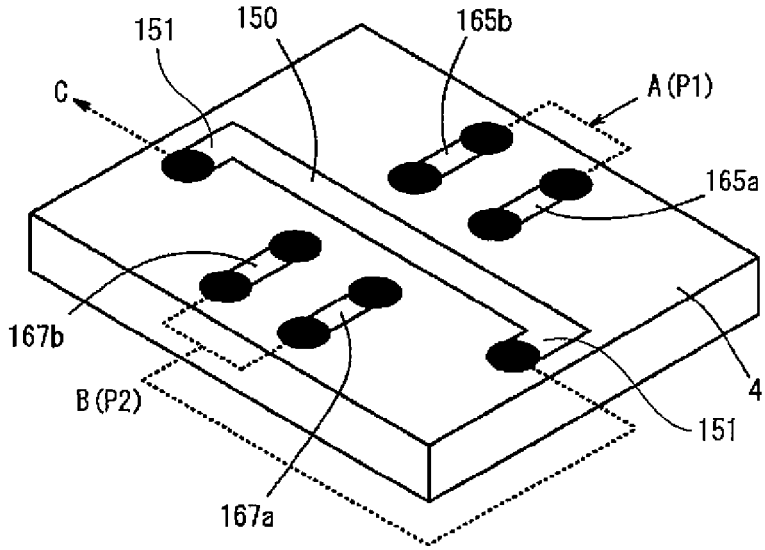
FIG. 14 is a perspective view showing the appearance of a central conductor assembly according to a still further embodiment of the present invention.

Both ends of the second central conductor 150 may have bent portions 151. When both end portions of the second central conductor 150 are bent in the same direction as that of current flowing through the first central conductor, larger impedance change is obtained than when only one end portion is bent, and a longer second central conductor 150 provides larger inductance. As shown in FIG. 14, a second central conductor 150 having one end portion bent in the same direction as that of current in the first central conductor and the other end portion bent in an opposite direction can have large inductance while suppressing impedance change. With bent portions 151, 151 having different lengths, the second central conductor can have large inductance together with adjusted impedance.

The second feature of the present invention is that the second central conductor 150 is in a coil shape having 1.5 turns or more, which is constituted by pluralities of strip-shaped conductors formed on a main surface side of the substrate and series-connected to at least one strip-shaped conductor formed on a rear surface side of the substrate, pluralities of the strip-shaped conductors for the second central conductor 150 being crossing the first central conductor on a main surface side of the substrate via a magnetic layer or a dielectric layer. This structure provides larger inductance, thereby miniaturizing the central conductor assembly 4. The second central conductor 150 typically has two strip-shaped conductors on the main surface side and one strip-shaped conductor on the rear surface side, though not restrictive. Increase in the number of strip-shaped conductors on both main and rear surface sides results in the increased number of turns of a coil, and thus increased inductance.

Example 1

This non-reciprocal circuit device has the basic structure shown in FIG. 1, which comprises a central conductor assembly 4 formed by laminating rectangular substrates (magnetic layers) of a magnetic material (microwave ferrite) provided with lines for the first and second central conductors, a second central conductor 150 being crossing a first central conductor with electric insulation on a main surface as shown in FIG. 4; a multi-layer ceramic substrate 5 comprising capacitors Ci and Cf formed therein, electrode patterns 501-503 formed on the surface, and a resistance element R mounted on the surface; a lower case 7 receiving the multi-layer ceramic substrate 5; a permanent magnet 3 applying a DC magnetic field to the microwave ferrite; and an upper case 1 receiving the permanent magnet 3 and engaging the lower case 7.

As shown in FIG. 2, the equivalent circuit of this non-reciprocal circuit device comprises a first inductance element Lin, a second inductance element Lout, a first capacitance element Ci constituting a first parallel resonance circuit with the first inductance element Lin, a second capacitance element Cf constituting a second parallel resonance circuit with the second inductance element Lout, and a resistance element R connected between a first input/output port P1 and a second input/output port P2.

Figure 15:
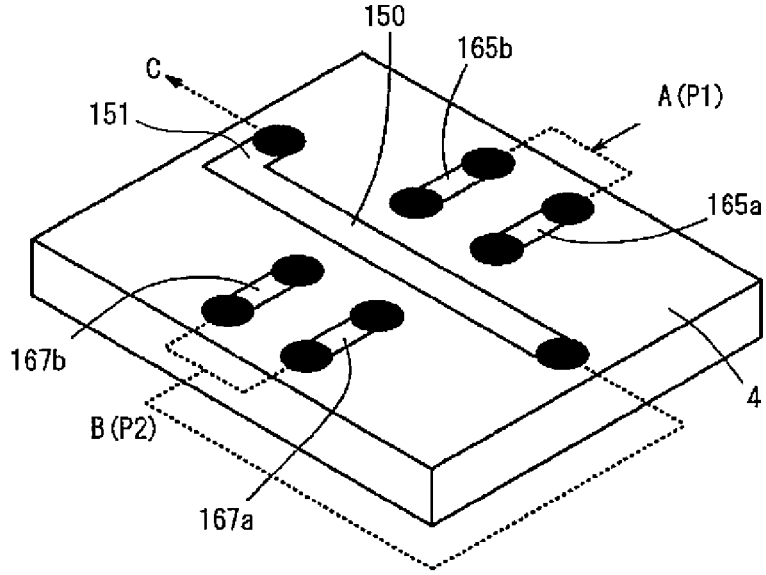
FIG. 15 is a perspective view showing the appearance of a central conductor assembly according to a still further embodiment of the present invention.

FIG. 15 shows the appearance of the central conductor assembly 4. This central conductor assembly 4 is the same as shown in FIG. 3, except for the bending direction of an end portion of the second central conductor 150, the position of a terminal electrode 200*a* (FIG. 4), and the position of a via-hole connected to the terminal electrode 200*a*. Accordingly, the bending direction of the end portion of the second central conductor 150 is opposite to that of high-frequency current flowing through the first central conductor.

The central conductor assembly 4 is formed by laminating magnetic layers provided with strip-shaped conductors for central conductors. The production method of the central conductor assembly 4 is as follows. First, materials for garnet ferrite comprising $Y_2O_3$, $Bi_2O_3$, $CaCO_3$, $Fe_2O_3$, $In_2O_3$, $Al_2O_3$ and $V_2O_5$ were wet-mixed by a ball mill, and the resultant slurry was dried, calcined at 850° C., and wet-pulverized in a ball mill to obtain polycrystalline magnetic ceramic powder. The magnetic ceramic powder had a composition of $(Y_{1.45}Bi_{0.85}Ca_{0.7})(Fe_{3.95}In_{0.3}Al_{0.4}V_{0.35})O_{12}$ (by atomic ratio). The magnetic ceramic powder was mixed with an organic binder (for example, polyvinyl butyral), a plasticizer (for example, butyl phthalyl butyl glycolate), and an organic solvent (for example, ethanol or butanol) in a ball mill, provided with adjusted viscosity, and then formed into three types of green sheets of magnetic ceramic (garnet ferrite) powder having thicknesses (after sintered) of 15 μm, 25 μm and 50 μm, respectively, by a doctor blade method. Two 50-μm-thick green sheets were used for a layer S1, a 25-μm-thick green sheet was used for a layer S2, and a 15-μm-thick green sheet was used for a layer S3.

Each green sheet was printed with a conductor paste of Ag, Cu, etc. in predetermined patterns to form electrode patterns for the first and second central conductors, and their through-holes were filled with the conductor paste to form via-holes. The green sheets provided with electrode patterns were laminated, heat-pressed, provided with slits at predetermined intervals by a steel blade, and then sintered to produce a substrate assembly comprising pluralities of central conductor assemblies. The substrate assembly was divided through the slits to provide separate central conductor assemblies.

The central conductor assembly 4 thus obtained had an external size of 1.4 mm×1.1 mm×0.16 mm, each line for the first central conductor having a width of 0.16 mm and a thickness of 10 μm, pitch (intercenter distance) between the first to third lines being 0.36 mm, and a gap between the third line 160 and the second central conductor 150 being 15 μm. The first central conductor including via-holes was as long as 0.94 mm. The second central conductor 150 had a width of 0.12 mm, a thickness of 10 μm and a length of 1.24 mm (including via-holes). The end portion of the second central conductor 150 was bent in parallel to the first central conductor, such that high-frequency current flowing therethrough was in an opposite direction to that of current flowing through the first central conductor. The length of the bent portion 151, distance between a centerline of the second central conductor 150 and a center of the via-hole of the bent portion 151, was 0.15 mm.

Used as a permanent magnet 3 applying a DC magnetic field to the central conductor assembly 4 was a La—Co-containing ferrite magnet (YBM-9BE available from Hitachi Metal, Ltd.) of 1.8 mm×1.5 mm×0.35 mm having a residual magnetic flux density Br of 430-450 mT and intrinsic coercivity iHc of 382-414 kA/m.

The multi-layer ceramic substrate 5 was a laminate formed by laminating dielectric ceramic sheets provided with electrode patterns, and integrally sintering them, such that it contained capacitance electrodes constituting capacitors Ci, Cf. The multi-layer substrate had an upper surface on which electrodes 501-503 connected to terminal electrodes 200*a*-200*d* of the central conductor assembly 4 were formed, and a rear surface on which input/output terminals connected to mounting terminals IN, OUT, GND on a resin case 7 integrally molded with the lower metal case 2 and a ground terminal were formed.

As shown in FIG. 1, the multi-layer ceramic substrate 5 and the central conductor assembly 4 were disposed in this order in the resin case 7, and electrically connected, and further the permanent magnet 3 and the upper metal case 1 were disposed to obtain a non-reciprocal circuit device of 2.0 mm×2.0 mm×1.1 mm. This non-reciprocal circuit device had an operation center frequency of 1.95 GHz.

Comparative Example 1

The non-reciprocal circuit device of Comparative Example 1 was produced in the same manner as in Example 1 except for providing the second central conductor 150 of the central conductor assembly with no bent portion 151.

Figure 16:
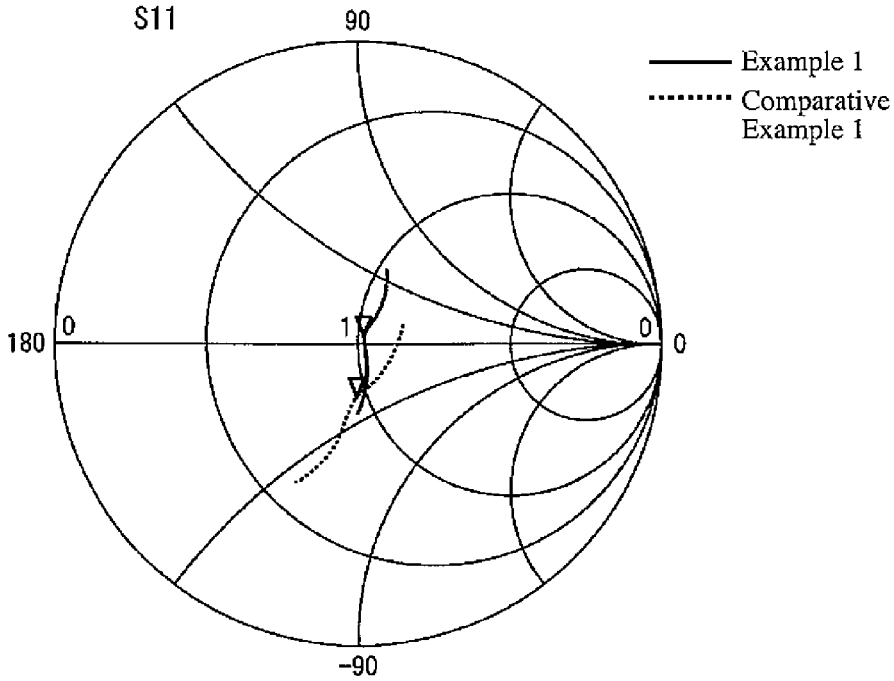
FIG. 16 is a Smith chart showing the S11 impedance characteristics of the non-reciprocal circuit devices of Example 1 and Comparative Example 1.
Figure 17:
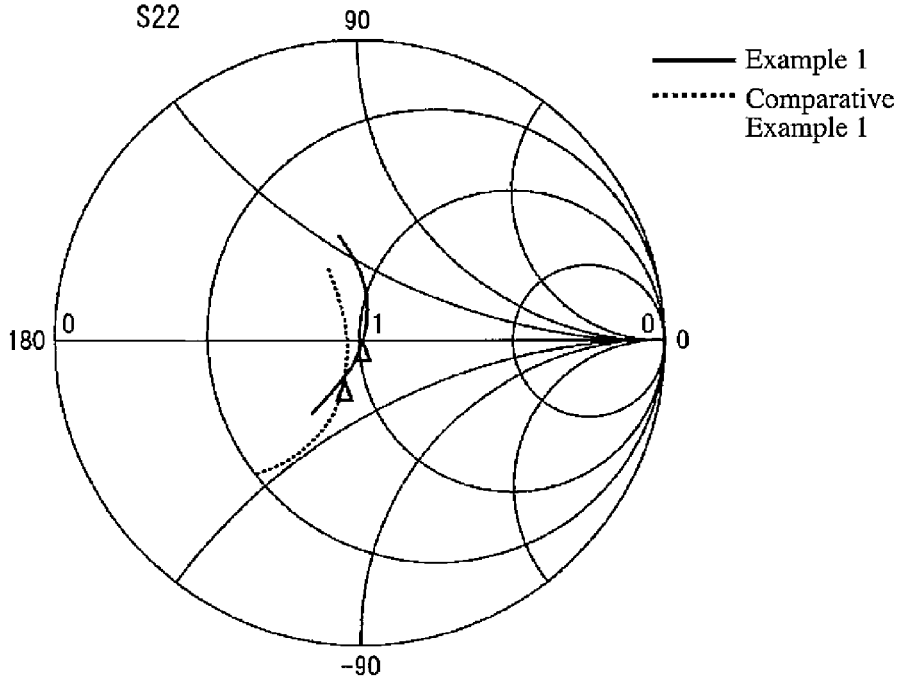
FIG. 17 is a Smith chart showing the S22 impedance characteristics of the non-reciprocal circuit devices of Example 1 and Comparative Example 1.
Figure 18:
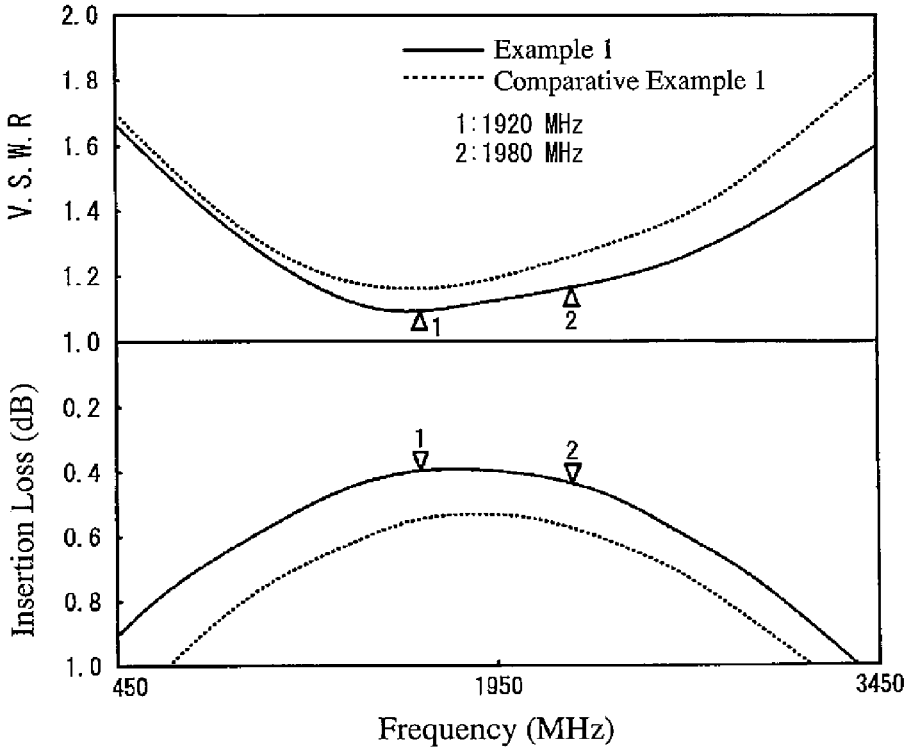
FIG. 18 is a graph showing the insertion loss characteristics and V.S.W.R characteristics [on the input (P1) side] of the non-reciprocal circuit devices of Example 1 and Comparative Example 1.
Figure 19:
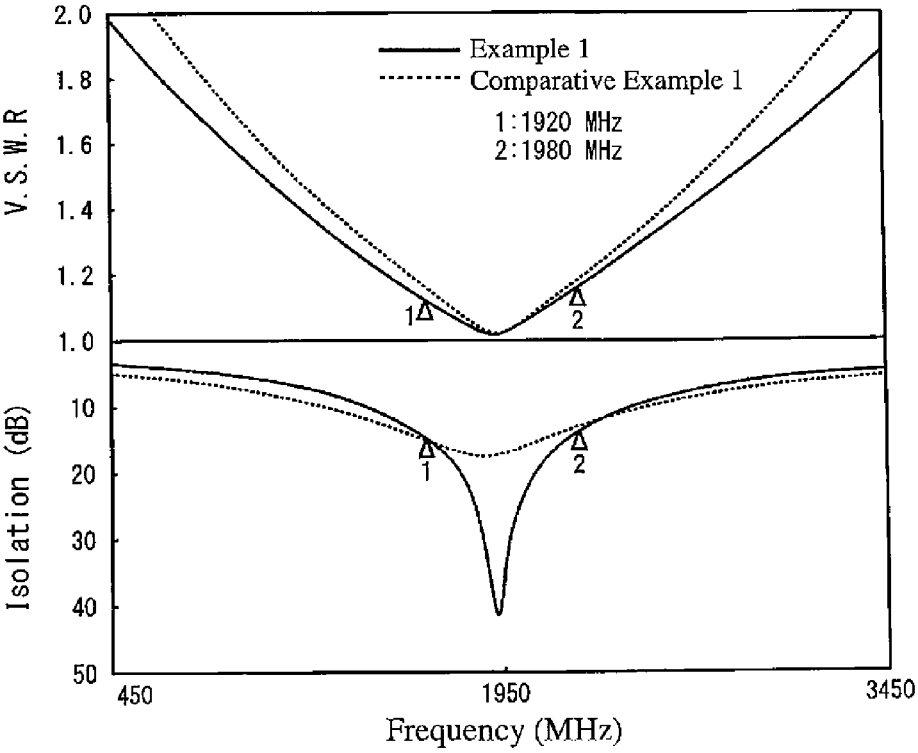
FIG. 19 is a graph showing the isolation characteristics and V.S.W.R characteristics [on the output (P2) side] of the non-reciprocal circuit devices of Example 1 and Comparative Example 1.

The measurement results of insertion loss and isolation of the non-reciprocal circuit devices of Example 1 and Comparative Example 1 are shown in FIGS. 16-19. FIG. 16 shows S11 impedance characteristics, and FIG. 17 shows S22 impedance characteristics. FIG. 18 shows insertion loss characteristics and V.S.W.R characteristics on the input (P1) side, and FIG. 19 shows isolation characteristics and V.S.W.R characteristics on the output (P2) side. The input/output impedance of Comparative Example 1 was strongly capacitive, while it was corrected in Example 1. The non-reciprocal circuit device of Example 1 had as small insertion loss as 0.4 dB, while the non-reciprocal circuit device of Comparative Example 1 had as large insertion loss as about 0.55 dB. With respect to isolation, the non-reciprocal circuit device of Example 1 was larger than that of Comparative Example 1. The above results indicate that the bent portion 151 of the second central conductor 150 in the central conductor assembly have large influence on impedance characteristics, insertion loss characteristics and isolation characteristics.

Example 2

Figure 20:
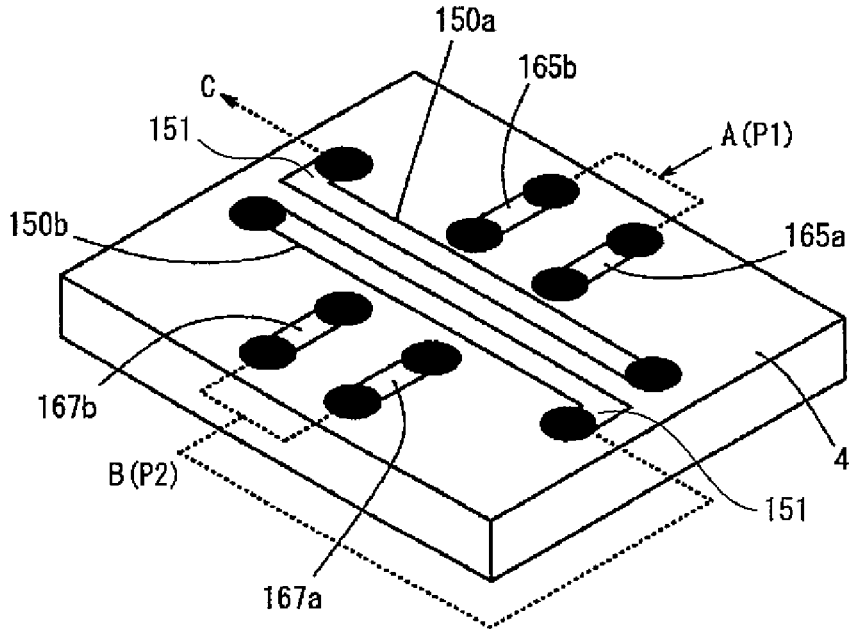
FIG. 20 is a perspective view showing the appearance of a central conductor assembly according to a still further embodiment of the present invention.
Figure 21:
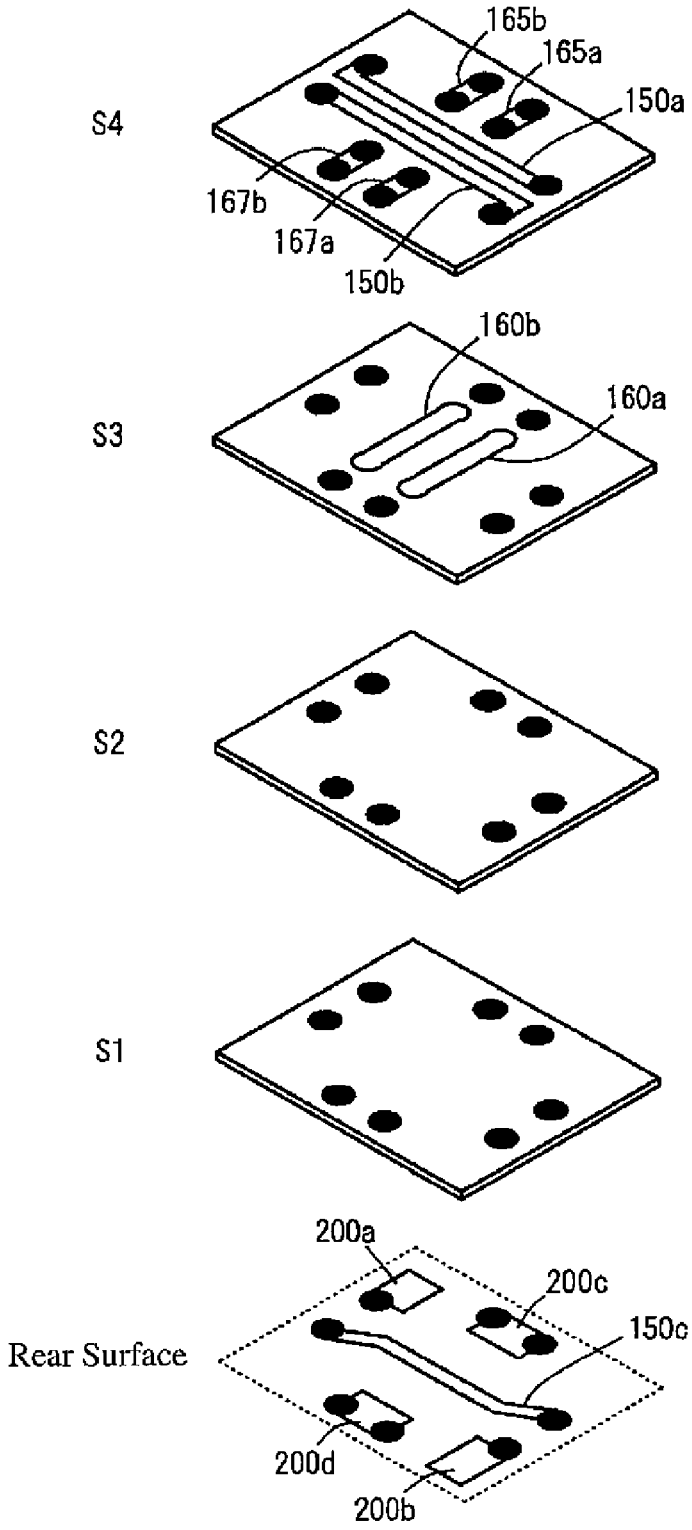
FIG. 21 is an exploded perspective view showing the internal structure of a central conductor assembly according to a still further embodiment of the present invention.

The non-reciprocal circuit device of Example 2 had the same basic structure and an external size as those of Example 1, except that its central conductor assembly 4 had an appearance shown in FIG. 20 and an internal structure shown in FIG. 21. 50-μm-thick green sheets were used for layers S1 and S2, a 25-μm-thick green sheet was used for a layer S3, and a 15-μm-thick green sheet was used for a layer S4.

Because of an operation center frequency of 900 MHz, lower than that of Example 1, the second central conductor of the central conductor assembly 4 was formed by connecting plural (two) strip-shaped conductors 150*a*, 150*b* formed on a main surface to one strip-shaped conductor 150*c* formed on a rear surface through via-holes, such that it functioned as a coil of 1.5 turns. The end portions of the strip-shaped conductors 150*a*, 150*b* were bent in opposite directions in parallel to the first central conductor.

This central conductor assembly had the same external size as that of Example 1. Each line for the first central conductor had a width of 0.12 mm and a thickness of 10 μm, a pitch (intercenter distance) of the first to third lines was 0.28 mm, and a gap between the third line 160 and the second central conductor 150 was 15 μm. The first central conductor including via-holes was as long as 1.04 mm. Each strip-shaped conductor 150*a*, 150*b* of the second central conductor had a width of 0.12 mm, a thickness of 10 μm and a length of 1.28 mm (including via-holes). The length (distance between a centerline of each second central conductor and a center of a via-hole in the bent portion) of the bent portion 151 was 0.12 mm.

Example 3

A non-reciprocal circuit device was produced in the same manner as in Example 1, using the same central conductor assembly as that of Example 2 except that end portions of lines 150*a*, 150*b* for the second central conductor were not bent.

Example 4

As shown in FIG. 14, a central conductor assembly was produced in the same manner as in Example 1, except that (a) the second central conductor 150 was formed by one line having a width of 0.12 mm and a thickness of 10 μm, that (b) one end portion of the second central conductor 150 was bent such that high-frequency current flowing therethrough was in an opposite direction to that of high-frequency current flowing through the first central conductor, that (c) the other end portion on the ground port side was bent such that high-frequency current flowing therethrough was in the same direction as that of high-frequency current flowing through the first central conductor, and that (d) each bent portion was as long as 0.12 mm. Using this central conductor assembly, a non-reciprocal circuit device was produced. Capacitors formed in the multi-layer ceramic substrate 5 had higher capacitance than those of Example 2.

Figure 22:
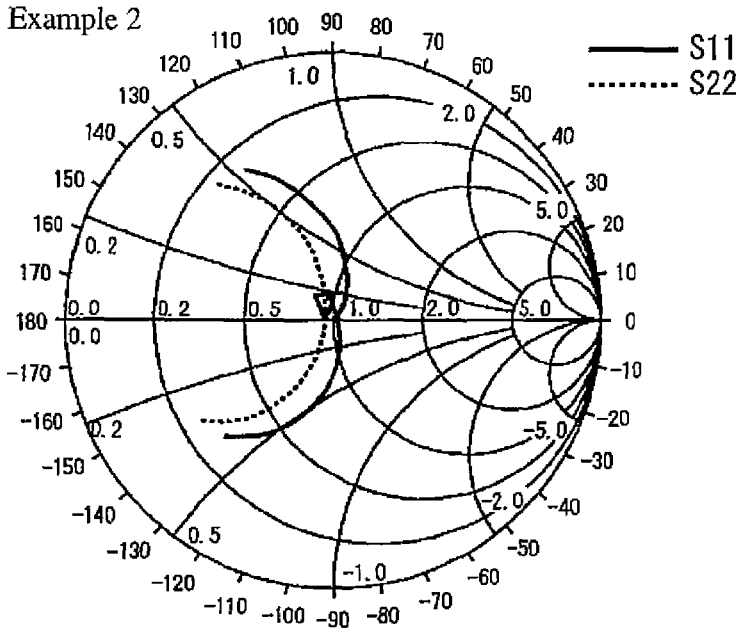
FIG. 22 is a Smith chart showing the impedance characteristics of the non-reciprocal circuit device of Example 2.
Figure 23:
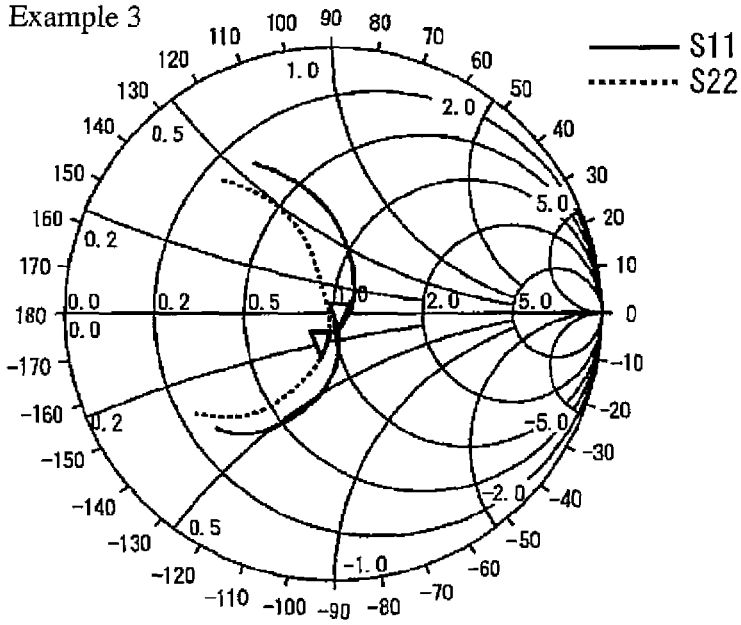
FIG. 23 is a Smith chart showing the impedance characteristics of the non-reciprocal circuit device of Example 3.
Figure 24:
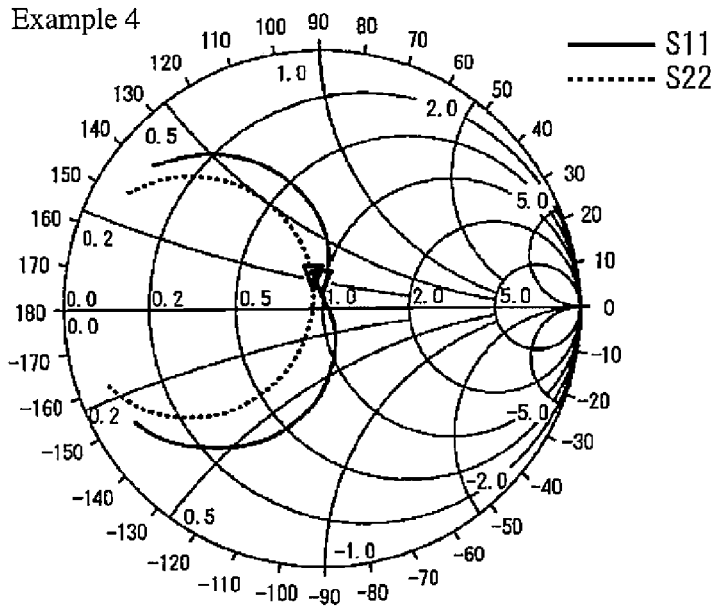
FIG. 24 is a Smith chart showing the impedance characteristics of the non-reciprocal circuit device of Example 4.
Figure 25:
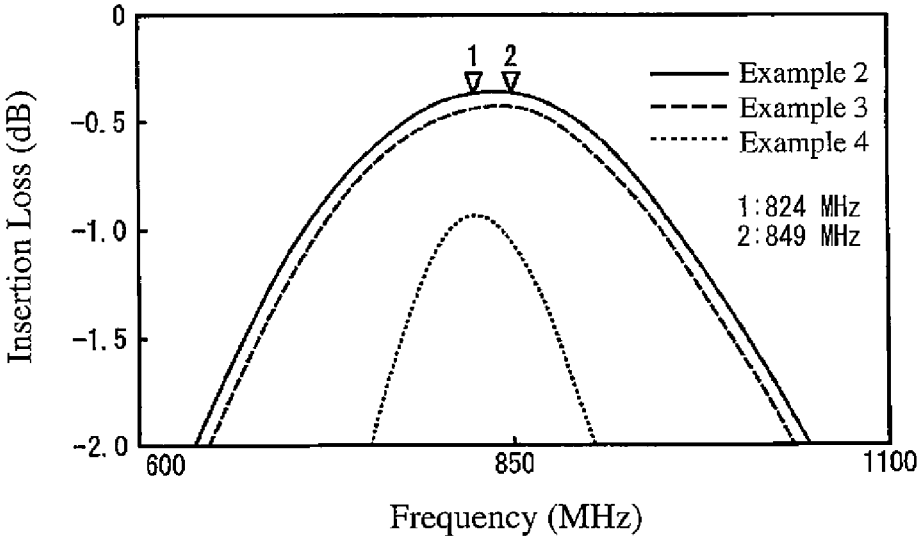
FIG. 25 is a graph showing the insertion loss characteristics of the non-reciprocal circuit devices of Examples 2-4.
Figure 26:
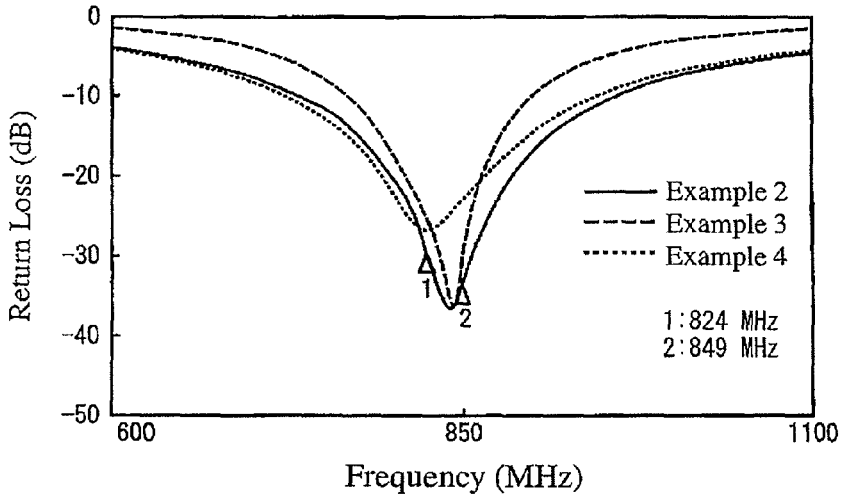
FIG. 26 is a graph showing the return loss characteristics of the non-reciprocal circuit devices of Examples 2-4.
Figure 27:
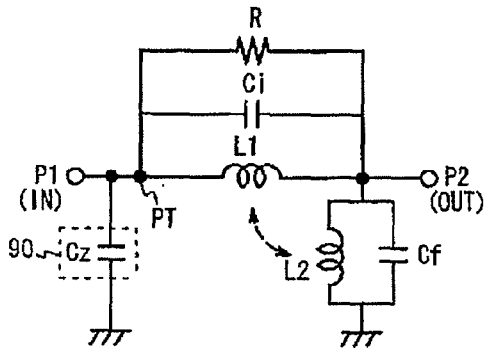
FIG. 27 is a view showing the equivalent circuit of a conventional non-reciprocal circuit device.
Figure 28:
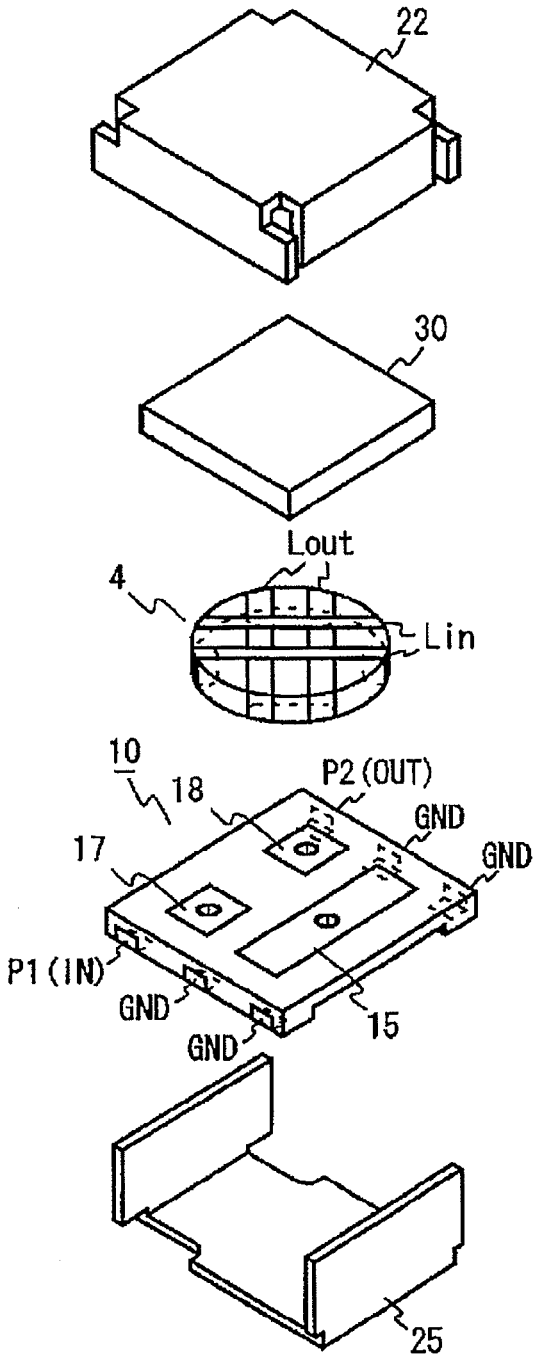
FIG. 28 is an exploded perspective view showing a conventional non-reciprocal circuit device.
Figure 29:
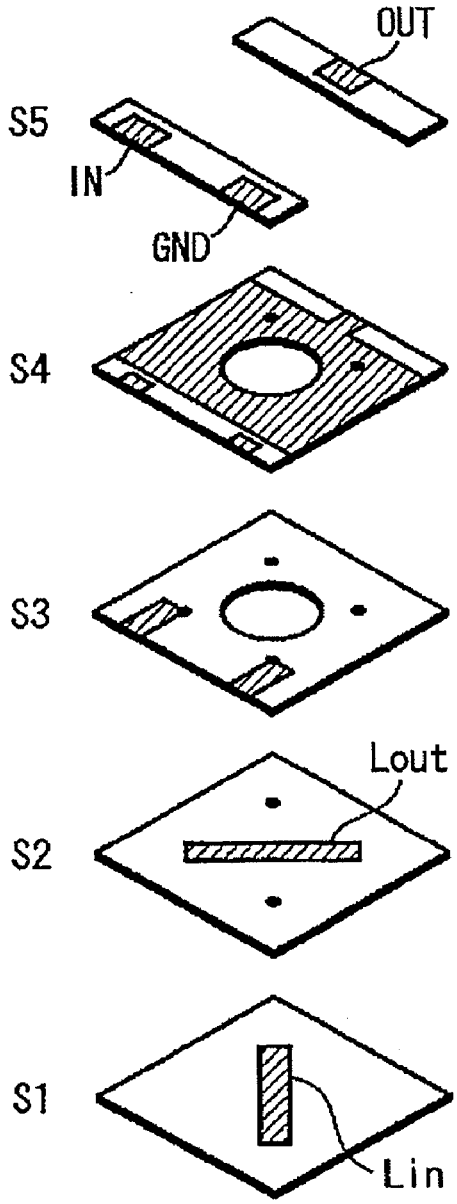
FIG. 29 is an exploded perspective view showing the internal structure of a conventional central conductor assembly.

FIGS. 22-24 show the S11 and S22 impedance characteristics of Examples 2-4, respectively. FIGS. 25 and 26 show the insertion loss and return loss on the input (P1) side of Examples 2-4, respectively. The non-reciprocal circuit devices of Examples 2 and 3 each comprising a second central conductor 150 constituted by a coil of 1.5 turns had better insertion loss and return loss characteristics than those of the non-reciprocal circuit device of Example 4 comprising a second central conductor 150 having a bent portion but constituted by one line. Among them, the non-reciprocal circuit device of Example 2 comprising a second central conductor 150 constituted by a coil of 1.5 turns and having a bent portion 151 showed the best insertion loss and return loss characteristics.

Effect of the Invention

Using the central conductor assembly of the present invention, in which at least one end portion of the second central conductor is bent such that high-frequency current flows therethrough in the same direction as or in an opposite direction to that of high-frequency current flowing through the first central conductor, it is possible to provide a small non-reciprocal circuit device with small impedance deviation and excellent electric characteristics such as insertion loss, etc. without adding a matching circuit. Also, with the second central conductor in the form of a coil of 1.5 turns or more constituted by pluralities of strip-shaped conductors formed on a main surface side of the substrate and series-connected to at least one strip-shaped conductor formed on a rear surface side of the substrate, large inductance can be obtained, contributing to the miniaturization of the central conductor assembly.

What is claimed is:

1. A central conductor assembly for use in a non-reciprocal circuit comprising a first inductance element between a first input/output port and a second input/output port, and a second inductance element between the second input/output port and a ground port, a magnetic substrate being integrally provided with a first central conductor constituting said first inductance element and a second central conductor constituting said second inductance element;

said second central conductor being crossing said first central conductor on a main surface side of said substrate via a magnetic layer or a dielectric layer; and at least one end portion of said second central conductor being bent, such that high-frequency current flows therethrough in the same direction as or in an opposite direction to that of high-frequency current flowing through said first central conductor, wherein a part of said first central conductor and said second central conductor are formed on a main surface of said substrate, while the other part of said first central conductor is formed in said substrate.

2. The central conductor assembly according to claim 1, wherein said first inductance element has smaller inductance than that of said second inductance element.

3. The central conductor assembly according to claim 1, wherein end portions of said first and second central conductors are connected to terminal electrodes formed on a bottom surface through via-holes or electrodes formed on side surfaces of the substrate.

4. The central conductor assembly according to claim 1, wherein said second central conductor is in the form of a coil of 1.5 turns or more constituted by pluralities of strip-shaped conductors formed on the main surface side of said substrate and series-connected to at least one strip-shaped conductor formed on a rear surface side of the substrate, and at least one end portion of said second central conductor is formed on the main surface side of said substrate.

5. A non-reciprocal circuit device comprising the central conductor assembly according to claim 1, a permanent magnet applying a DC magnetic field to said central conductor assembly, a first capacitance element constituting a first parallel resonance circuit with said first inductance element, and a second capacitance element constituting a second parallel resonance circuit with said second inductance element, said first and second capacitance elements being formed in a multi-layer substrate, and said central conductor assembly being mounted on a main surface of said multi-layer substrate.

6. A non-reciprocal circuit comprising the central conductor assembly recited in claim 1, a permanent magnet applying a DC magnetic field to said central conductor assembly, a first capacitance element constituting a first parallel resonance circuit with said first inductance element, and a second capacitance element constituting a second parallel resonance circuit with said second inductance element.

7. A method for adjusting the impedance of the non-reciprocal circuit of claim 6, the method comprising:

integrally providing a magnetic substrate with a first central conductor constituting said first inductance element and a second central conductor constituting said second inductance element;

disposing said second central conductor on the main surface side of said substrate such that it is crossing said first central conductor via a magnetic layer or a dielectric layer; and bending at least one end portion of said second central conductor, such that high-frequency current flows therethrough in the same direction as or in an opposite direction to that of high-frequency current flowing through said first central conductor, thereby adjusting the impedance of said second parallel resonance circuit at a resonance frequency.

8. The impedance-adjusting method of a non-reciprocal circuit according to claim 7, comprising bending an end portion of said second central conductor on the side of the ground port such that high-frequency current flows therethrough in the same direction as that of high-frequency current flowing through said first central conductor, or bending an end portion of said second central conductor on the side of the second input/output port such that high-frequency current flows therethrough in an opposite direction to that of high-frequency current flowing through said first central conductor, thereby moving impedance at a resonance frequency counterclockwise along an equi-conductance curve on a Smith chart.

9. The impedance-adjusting method of a non-reciprocal circuit according to claim 7, comprising bending an end portion of said second central conductor on the side of the ground port such that high-frequency current flows therethrough in an opposite direction to that of high-frequency current flowing through said first central conductor, or bending an end portion of said second central conductor on the side of the second input/output port such that high-frequency current flows therethrough in the same direction as that of high-frequency current flowing through said first central conductor, thereby moving impedance at a resonance frequency clockwise along an equi-conductance curve on a Smith chart.

10. The impedance-adjusting method of a non-reciprocal circuit according to claim 7, wherein said second central conductor is formed by series-connecting pluralities of strip-shaped conductors formed on a main surface side of said substrate to at least one strip-shaped conductor formed on a rear surface side of said substrate, to form said second central conductor in a coil of 1.5 turns or more.

* * * * *